US006080705A

United States Patent [19]

Kaimai et al.

[11] Patent Number: 6,080,705

[45] Date of Patent: Jun. 27, 2000

[54] REFRIGERATOR OIL, WORKING FLUID FOR REFRIGERATOR, AND METHOD FOR LUBRICATING REFRIGERATION SYSTEM

[75] Inventors: Takashi Kaimai; Hitoshi Takahashi, both of Toda, Japan

[73] Assignee: Japan Energy Corporation, Tokyo, Japan

[21] Appl. No.: 09/051,749

[22] PCT Filed: Sep. 8, 1997

[86] PCT No.: PCT/JP97/03160

§ 371 Date: Apr. 28, 1998

§ 102(e) Date: Apr. 28, 1998

[87] PCT Pub. No.: WO98/11182

PCT Pub. Date: Mar. 19, 1998

[30] Foreign Application Priority Data

Sep. 12, 1996 [JP] Japan ..... 8-262353

[51] Int. Cl.[7] ..... C10M 105/34; C10M 105/38; C10M 129/16; C10N 40/30

[52] U.S. Cl. ..... 508/495; 508/579; 252/67; 252/68

[58] Field of Search ..... 508/495, 579; 252/68, 67

[56] References Cited

U.S. PATENT DOCUMENTS

| | | | |
|---|---|---|---|
| 4,755,316 | 7/1988 | Magid et al. | 252/68 |
| 4,851,144 | 7/1989 | McGraw et al. | 252/68 |

FOREIGN PATENT DOCUMENTS

| | | |
|---|---|---|
| 0 378 176 | 7/1990 | European Pat. Off. . |
| 0377122 | 11/1990 | European Pat. Off. . |
| 0406479 | 9/1991 | European Pat. Off. . |
| 0 803 564 | 10/1997 | European Pat. Off. . |
| 933 721 | 8/1963 | United Kingdom . |
| 97/49787 | 12/1997 | WIPO . |

OTHER PUBLICATIONS

JP05032985, English Abstract, Feb. 1993.

*Primary Examiner*—Margaret Medley

*Attorney, Agent, or Firm*—Flynn, Thiel, Boutell & Tanis, P.C.

[57] ABSTRACT

This invention provides a refrigerator oil, a working fluid for a refrigerator, and a method for lubricating a refrigeration system, which can inhibit the creation of deposits attributable to metal working oils remaining within a refrigeration system. The refrigerator oil contains: a polyhydric alcohol ester compound as a lube base oil, and 0.5 to 4.5% by weight of at least one polyoxyalkylene compound. The working fluid for a refrigerator, containing: the above refrigerator oil, and a hydrofluorocarbon refrigerant. A method for lubricating a refrigeration system contaminated with metal working oils, containing a component sparingly soluble in the polyhydric alcohol ester compound or the hydrofluorocarbon refrigerant, or metal working oils, containing a component highly reactive with the polyhydric alcohol ester compound or the hydrofluorocarbon refrigerant, remaining therein, wherein the above working fluid for a refrigerator is used as a working fluid. According to the present invention, occurrence of deposits in the system, especially in a capillary in the system, can be prevented

9 Claims, 1 Drawing Sheet

REFRIGERATOR OIL, WORKING FLUID FOR REFRIGERATOR, AND METHOD FOR LUBRICATING REFRIGERATION SYSTEM

This application is a 371 of PCT/JP97/03160, filed on Sep. 08, 1997.

TECHNICAL FIELD

The present invention relates to a refrigerator oil for use in a refrigerant compressor for a domestic refrigerator or the like, and particularly to a refrigerator oil useful for a refrigerant compressor using a hydrofluorocarbon refrigerant, a working fluid for a refrigerator and a lubricating method using the same.

BACKGROUND ART

Compressors utilizing a refrigerant are used in refrigeration systems, such as refrigerators, car air conditioners, industrial refrigerators, and room air conditioners, and hydrofluorocarbon refrigerants (nonchlorine compounds, that is, hydrogen- and fluorine-containing hydrocarbons, free from chlorine, with at least a part of the hydrogen atoms substituted with fluorine; hereinafter referred to as "HFC refrigerants") have drawn attention as refrigerants for these refrigeration systems. R134a, R125, R32, R143a, and R152a, each consisting of a single compound, and R407C and R410A, each consisting of a mixture of those compounds, have been proposed as the HFC refrigerant. Regarding a base oil, for a refrigerator oil, used in combination with the hydrofluorocarbon refrigerant, a polyhydric alcohol ester compound is known to have excellent properties.

A refrigeration system comprises a refrigerating compressor, a condenser, an expansion mechanism (e.g., expansion valve, capillary tube and the like), an evaporator, etc., connected to one another in series. Various metal working oils are used for the production of components for these equipment and for assembling the system, and these metal working oils remain in the assembled refrigeration system. The metal working oils contain additives, for example, a sulfur extreme pressure agent, such as a disulfide, and a phosphorus extreme pressure agent, such as a phosphoric ester.

DISCLOSURE OF THE INVENTION

The metal working oil containing a sulfur or phosphorus extreme pressure agent is less likely to dissolve in a hydrofluorocarbon refrigerant. Further, this metal working oil, in some cases, contains a component highly reactive with a polyhydric alcohol ester compound or a hydrofluorocarbon refrigerant. For this reason, a sparingly soluble additive component(s) in a metal working oil, such as a sulfur extreme pressure agent or a phosphorus extreme pressure agent, and a reaction product(s) with a refrigerator oil or the like, in some cases, locally deposit within the refrigeration system. Operation of the refrigeration system causes this deposit to accumulate inside an extremely narrow tube, such as a capillary tube, in the system, resulting in a lowered flow rate of the refrigerant and increased differential pressure to deteriorate the efficiency, which often makes it impossible for the refrigeration system to exhibit satisfactory performance.

The present invention aims to solve the above problems, and an object of the present invention is to provide a refrigerator oil, a working fluid for a refrigerator, and a method for lubricating a refrigeration system, which when a polyhydric alcohol ester compound is used as a base oil for a refrigerator oil, can inhibit the creation of deposits, attributable to the residual metal working oil, in the system, particularly in a capillary section.

The present inventors have made extensive and intensive studies with a view to solving the above problems and, as a result, have found that addition of a particular polyoxyalkylene compound into a polyhydric alcohol ester compound as the base oil can prevent the creation of deposits in the system, which has led to the completion of the present invention.

Thus, the refrigerator oil according to the present invention comprises: a polyhydric alcohol ester compound as a lube base oil, and 0.5 to 4.5% by weight of at least one polyoxyalkylene compound represented by the following formula (1):

$$R_1—O—(R_2—O—)_n—R_3 \quad (1)$$

wherein $R_1$ represents an alkyl group having 1 to 8 carbon atoms, $R_2$ represents an alkylene group having 1 to 4 carbon atoms, $R_3$ represents hydrogen or an alkyl group having 1 to 8 carbon atoms and n is a number representing the degree of polymerization.

The working fluid for a refrigerator according to the present invention comprises the above refrigerator oil and a hydrofluorocarbon refrigerant. Further, the method for lubricating a refrigeration system contaminated with metal working oils, containing a component sparingly soluble in the polyhydric alcohol ester compound or the hydrofluorocarbon refrigerant, or metal working oils, containing a component highly reactive with the polyhydric alcohol ester compound or the hydrofluorocarbon refrigerant, remaining therein, according to the present invention, comprises using the above working fluid for a refrigerator.

BEST MODE FOR CARRYING OUT THE INVENTION

Polyhydric Alcohol Ester Compound

Figure 1:
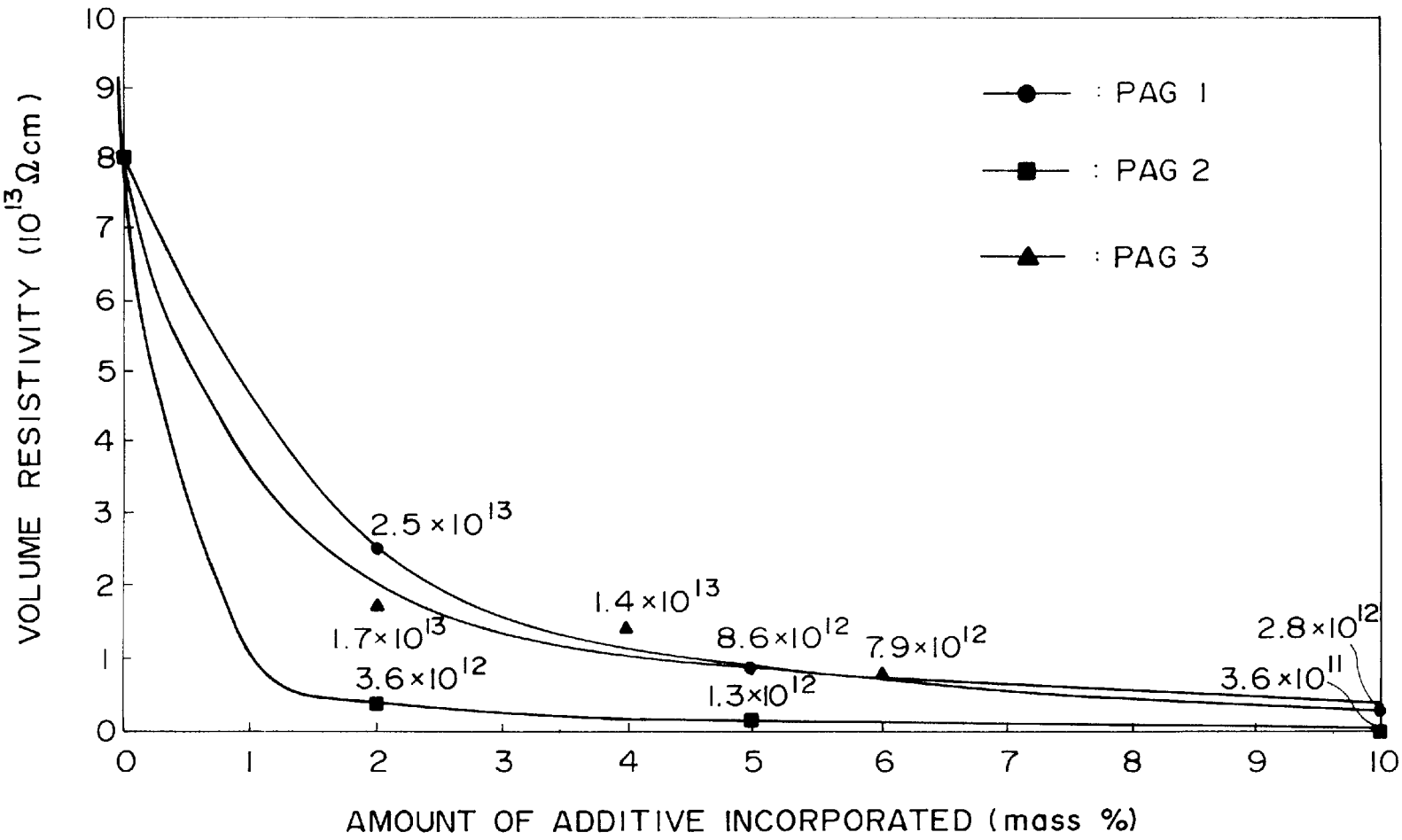
FIG. 1 is a diagram showing the results of the measurement of an electrical insulating property with the amount of PAG (polyoxyalkylene compound) added to the base oil being varied.

Polyhydric alcohol ester compounds usable in the present invention include polyhydric alcohol esters prepared from polyhydric alcohols with the number of hydroxyl groups being 2 to 6 and fatty acids. Compositions having excellent heat stability, and hydrolytic stability and metal corrosive resistance can be suitably selected from these polyhydric alcohol esters. Among these, a neutral ester prepared by reacting a polyhydric alcohol, having a neo type skeleton with five carbon atoms, with a monovalent saturated fatty acid or a mixture of the monovalent saturated fatty acid and a divalent saturated fatty acid is particularly preferred. The acid value of the ester is preferably not more than 0.1 mg KOH/g, particularly preferably not more than 0.02 mg KOH/g.

Polyhydric alcohols usable herein include neopentyl glycol, trimethylolpropane, pentaerythritol, and dipentaerythritol with dihydric or tetrahydric alcohols being preferred. In particular, a mixture of a neopentyl glycol ester with a pentaerythritol ester is preferred because the mixture has a good solubility in the HFC refrigerant and the viscosity can be appropriately adjusted.

Monovalent saturated fatty acids usable herein include straight-chain monovalent saturated fatty acids having 5 to 8 carbon atoms and non-neo type branched-chain monovalent saturated fatty acid having 5 to 9 carbon atoms and a mixture of the non-neo type branched-chain monovalent saturated fatty acid(s) having 5 to 9 carbon atoms with the straight-chain monovalent saturated fatty acid(s) having 5 to 8 carbon atoms. The branched-chain monovalent saturated fatty acid is preferably a monovalent saturated fatty acid with a methyl or ethyl group attached as a branch to the carbon atom at the α- or β-position. In this connection, it should be noted that a polyhydric alcohol ester prepared from a fatty acid having 1 to 4 carbon atoms has problems of lubricity, hydrolytic resistance and metal corrosive resistance. Specific examples of the branched-chain monovalent saturated fatty acids usable herein include 2-methylpentanoic acid, 2-ethylpentanoic acid, 2-methylhexanoic acid, 2-ethylhexanoic acid, 2-methylheptanoic acid, 2-ethylheptanoic acid, and 3,5,5-trimethylhexanoic acid, and examples of the straight-chain monovalent saturated fatty acids usable herein include n-pentanoic acid, n-hexanoic acid, n-heptanoic acid, and n-octanoic acid. Further, the monovalent saturated fatty acid(s) may be also used in combination with a divalent saturated fatty acid(s), such as succinic acid, glutaric acid, adipic acid, pimelic acid, etc., to prepare a lube base oil of a complex ester having relatively high viscosity.

Polyoxyalkylene Compound

The polyoxyalkylene compound used in the present invention has a structure represented by the formula (1).

$$R_1—O—(R_2—O—)_n—R_3 \quad (1)$$

$R_1$ represents an alkyl group having 1 to 8 carbon atoms with a methyl, ethyl, or butyl group being preferred. $R_2$ represents an alkylene group having 1 to 4 carbon atoms, and, more specifically, methylene, ethylene, propylene and butylene groups may be mentioned. Therefore, as the $—R_2—O—$ in the formula (1), there are mentioned oxyalkylene groups such as oxymethylene group, oxyethylene group, oxypropylene group and oxybutylene group and the $—(R_2—O—)_n—$ may be a homopolymer of a single oxyalkylene group selected from these oxyalkylene groups or a copolymer formed by polymerization of two or more of the oxyalkylene groups. When the $—(R_2—O—)_n—$ is a copolymer, it may be either a block copolymer or a random copolymer. The polymer part, $—(R_2—O—)_n—$, is preferably a homopolymer of an oxypropylene group or a copolymer containing an oxypropylene group, especially preferably, a copolymer of an oxyethylene group and an oxypropylene group. Although this copolymer may be either a block copolymer or a random copolymer, the block copolymer is particularly preferred. The proportion of the oxypropylene group is preferably not less than 50%, particularly preferably not less than 70%. $R_3$ represents hydrogen or an alkyl group having 1 to 8 carbon atoms. It is preferably hydrogen. That is, the terminal being a hydroxyl group is preferred. n is a number representing the degree of polymerization. When the foregoing polyoxyalkylene compound has an excessively high molecular weight, the solubility is likely to be lowered, while an excessively low molecular weight results in high evaporability. For this reason, n is preferably a number corresponding to a molecular weight of 300 to 3,000. It is still preferably 300 to 1,500, still more preferably 300 to 1,200.

The polyoxyalkylene compound is added in an amount of 0.5 to 4.5% by weight based on the weight of the refrigerator oil. When the addition is insufficient, occurrence of deposits attributable to additives or the like, used in metal working oils, in the system cannot be satisfactorily prevented. Therefore, the polyoxyalkylene compound is preferably added in an amount of at least 1% by weight. On the other hand, even if this compound is added in an amount exceeding 4.5% by weight, any further advantageous effect which reflects such excess addition will not be obtained in reducing the deposits and, therefore, an addition exceeding 4.5% by weight is uneconomical. More preferably, the polyoxyalkylene compound is added in an amount of not more than 3.5% by weight.

Further, since in closed-type refrigerators (e.g., a domestic refrigerator), a compressor and a motor are integrally incorporated therein, it is desirable that the refrigerator oil have a high electrical insulating property. Addition of the polyoxyalkylene compound lowers the electrical insulating property. Especially, when the polyoxyalkylene compound is composed of a copolymer, lowering of the electrical insulating property is more likely to occur with an increase in the proportion of an oxyethylene group in the oxyalkylene groups. In addition, this tendency is further enhanced with a decrease in the molecular weight of the polyoxyalkylene compound. With the taking also into account this point, the addition of the polyoxyalkylene compound is preferably not more than 4.5% by weight. Still further, it is desirable that the addition be so adjusted that the refrigerator oil may have a volume resistivity of at least $10^{12}$ Ωcm to $10^{13}$ Ωcm, preferably at least $10^{13}$ Ωcm.

Hydrofluorocarbon Refrigerant

Hydrofluorocarbon refrigerants usable in the present invention include those, wherein one or more hydrogens in a hydrocarbon having 1 to 2 carbon atoms has been substituted with fluorine(s), such as 1,1,1,2-tetrafluoroethane (R134a), pentafluoroethane (R125), difluoromethane (R32), 1,1,1-trifluoroethane (R143a), and 1,1-difluoroethane (R152a). Mixed refrigerants, such as R407C and R410A, may also be used.

Refrigerator Oil

The viscosity of the refrigerator oil according to the present invention may be suitably modified. It is generally 5 to 500 cSt at 40° C. In particular, the viscosity is 8 to 32 cSt at 40° C. for refrigerators, 25 to 100 cSt at 40° C. for room air conditioners and industrial applications, and 8 to 30 cSt at 100° C. for car air conditioners.

Conventional additives, for example, phosphate compound antiabrasion agents, such as triaryl phosphates and trialkyl phosphates; metal deactivators, such as benzotriazole derivatives and alkenylsuccinic esters; antioxidants, such as DBPC (2,6-di-tert-butyl-p-cresol) and p,p'-dioctyldiphenylamine; epoxy compounds as stabilizers for HFC refrigerants, such as 2-ethylhexyl glycidyl ether, sec-butyl phenyl glycidyl ether and monoglycidyl ethers containing an acyl group having 5 to 10 carbon atoms, may be optionally incorporated as other additives.

Working Fluid for Refrigerator

The working fluid for a refrigerator according to the present invention comprises a mixture of the above refrigerator oil with a refrigerant. The mixing weight ratio of the refrigerator oil to the refrigerant is generally preferably (10:90) to (90:10), particularly preferably (20:80) to (80:20).

The refrigerant is preferably an HFC refrigerant free from chlorine. However, it is also possible to use chlorofluorocarbons (chlorine- and fluorine-substituted hydrocarbons), hydrochlorofluorocarbons (chlorine- and fluorine-containing hydrocarbons), ammonia refrigerant, hydrocarbon refrigerants and the like.

The present invention will be described in more detail with reference to the following examples, though it is not limited to these examples only. In the following examples and comparative examples, sample oils are prepared for tests and evaluated.

For these sample oils, an ester, which had been prepared by reacting pentaerythritol with branched-chain saturated fatty acids having 8 and 9 carbon atoms and had a viscosity at 40° C. of 68 cSt, was used as a lube base oil. The following PAGs 1 to 4, polyoxyalkylene compounds, were added, in the respective proportions specified in Table 1, or not added, to the base oil, thereby preparing sample oils 1 to 6.

PAG 1 was a compound having a structure represented by the formula $CH_3$—O—$(PO)_m(EO)_n$—H wherein PO represents an oxypropylene group, EO represents an oxyethylene group, m and n represent the degree of polymerization with m:n=8:2. This compound had a molecular weight of about 1,000.

PAG 2 was a compound having a structure represented by the formula $C_4H_9$—O—$(PO)_m(EO)_n$—H wherein PO represents an oxypropylene group, EO represents an oxyethylene group and m and n represent the degree of polymerization with m:n=5:5. This compound had a molecular weight of about 500.

PAG 3 is a compound having a structure represented by the formula $CH_3$—O—$(PO)_m(EO)_n$—$CH_3$ wherein PO represents an oxypropylene group, EO represents an oxyethylene group and m and n represent the degree of polymerization with m:n=8:2. This compound had a molecular weight of about 1,000.

PAG 4 is a compound having a structure represented by the following formula $CH_3$—O—$(BO)_m(PO)_n$—$CH_3$ wherein BO represents an oxybutylene group, PO represents an oxypropylene group and m and n represent the degree of polymerization with m:n=5:5. This compound had a molecular weight of about 1,000.

The contamination in the interior of the refrigeration system attributable to the deposition of the working oil was evaluated using an actual machine. The following refrigeration system for a refrigerator was used for the evaluation. A mixture of the refrigerant with the refrigerator oil was compressed by means of a compressor, cooled in a condenser to prepare a liquefied mixture. Thereafter, the liquid was lead through a capillary (having an inner diameter of 0.6 mm and a length of 1 m and made of copper) to an evaporator where the pressure was reduced for vaporization, thereby conducting heat exchange through the evaporator. The vaporized refrigerant and the refrigerator oil were returned to the compressor.

65 g of a refrigerant (R407C, that is, a mixture of R32, R125, and R134a in a weight ratio of 23:25:52), 250 ml of the sample oil (a refrigerator oil), and 2% by weight, based on the sample oil, of a mixture of a plurality of working oils for use in production of refrigerators were filled into a 200-W refrigerant compressor, and the compressor was operated at a vaporization temperature of −20 to −25° C. for 200 hr. Thereafter, the amount of the deposits produced within the capillary was evaluated. The sample oil was graded as 5 when a thick deposit was created on the whole surface. The grade was lowered with a reduction in the amount of the deposits, and the sample oil was graded as zero (0) when no deposit was observed. Grades 1 to 4 are as follows:

Grade 1: Dot-like deposits scattered within the capillary.

Grade 2: Some of the dot-like deposits scattering within the capillary adhered to each other.

Grade 3: Almost all the dot-like deposits scattering within the capillary adhered to each other.

Grade 4: The deposits thinly covered the whole surface.

The results are summarized in Table 1.

TABLE 1

| | Sample Oil 1 | Sample Oil 2 | Sample Oil 3 | Sample Oil 4 | Sample Oil 5 | Sample Oil 6 |
|---|---|---|---|---|---|---|
| Additive Added | PAG 1 | PAG 1 | PAG 2 | PAG 3 | PAG 4 | |
| Amount (wt. %) | 4 | 2 | 2 | 4 | 4 | None |
| Grade on Deposition | 0 | 0 | 0 | 1 | 1 | 5 |

Electrical insulating properties with the amount of PAGs 1 to 3 added to the base oil being varied were evaluated, and the results are shown in FIG. 1. As can be seen from FIG. 1, the electrical insulating properties are lowered with an increase in the amount of added PAGs. It will be noted that electrical insulating property satisfactory for practical use (volume resistivity of not lower than $10^{13}$ Ωcm) can be provided by addition of PAG 1 or PAG 3 in an amount not exceeding 4.5% by weight. In case of PAG 1 having a high proportion (m:n=50:50) of oxyethylene groups and a small molecular weight (about 500), addition not exceeding about 1% by weight provides an electrical insulating property satisfactory for practical use (volume resistivity of not lower than $10^{13}$ Ωcm).

INDUSTRIAL APPLICABILITY

According to the present invention, a polyhydric alcohol ester compound is used as a lube base oil, and a predetermined amount of a particular polyoxyalkylene compound is incorporated thereinto. This can inhibit the creation of a deposit within a refrigeration system attributable to a working oil remaining in the system, eliminating a problem of a deterioration in efficiency of the refrigeration system. The present invention is particularly suitable for use in a compressor utilizing a refrigerant such as a hydrofluorocarbon.

What is claimed is:

1. A refrigerator oil having a volume resistivity of at least $10^{13}$ Ωcm and comprising: a polyhydric alcohol ester compound having an acid value of not more than 0.1 mg KOH/g as a lube base oil, and 0.5 to 4.5% by weight of at least one polyoxyalkylene compound represented by the following formula (1)

$$R_1—O—(R_2—O—)_n—R_3 \quad (1)$$

wherein $R_1$ represents an alkyl group having 1 to 8 carbon atoms, $R_2$ represents an alkylene group having 1 to 4 carbon atoms, $R_3$ represents hydrogen or an alkyl group having 1 to 8 carbon atoms, n is a number representing the degree of polymerization corresponding to a molecular weight of 300 to 1200 of the polyoxyalkylene compound, —$(R_2$—O—$)_n$ is a polymer containing not less than 50% of oxypropylene groups and the polyhydric alcohol ester compound is formed by reacting a monovalent saturated fatty acid or a mixture of a monovalent saturated fatty acid and a divalent saturated fatty acid with at least one polyhydric alcohol selected from the group consisting of neopentyl glycol, trimethylolpropane, pentaerythritol and dipentaerythritol.

2. A working fluid for a refrigerator, comprising: the refrigerator oil according to claim 1, and a hydrofluorocarbon refrigerant.

3. The refrigerator oil according to claim 1, wherein said polyhydric alcohol ester is a mixture of a neopentyl glycol ester and a pentaerythritol ester.

4. The refrigerator oil according to claim 1, wherein said polyhydric alcohol ester has an acid value not more than 0.02 mg KOH/g.

5. The refrigerator oil according to claim 1, wherein 0.5–4% by weight of the polyoxyalkylene compound is present.

6. The refrigerator oil according to claim 1, wherein 0.5–2% by weight of the polyoxyalkylene compound is present.

7. A method of lubricating a refrigeration system with a working fluid comprising a hydrofluorocarbon refrigerant and a refrigerator oil having a volume resistivity of at least $10^{13}$ Ωcm and comprising a polyhydric alcohol ester compound having an acid value of not more than 0.1 mg KOH/g as a lube base oil and 0.5–4.5% by weight of at least one polyoxyalkylene compound represented by the following formula (I)

$$R_1—O—(R_2—O—)_n—R_3 \quad (1)$$

wherein $R_1$ represents an alkyl group having 1 to 8 carbon atoms, $R_2$ represents an alkylene group having 1 to 4 carbon atoms, $R_3$ represents hydrogen or an alkyl group having 1 to 8 carbon atoms, n is a number representing the degree of polymerization corresponding to a molecular weight of 300 to 1200 of the polyoxyalkylene compound, $—(R_2—O—)_n$ is a polymer containing not less than 50% of oxypropylene groups and the polyhydric alcohol ester compound is formed by reacting a monovalent saturated fatty acid or a mixture of a monovalent saturated fatty acid and a divalent saturated fatty acid with at least one polyhydric alcohol selected from the group consisting of neopentyl glycol, trimethylolpropane, pentaerythritol and dipentaerythritol, said refrigeration system being contaminated with metal working oils which contain a component sparingly soluble in the polyhydric alcohol ester compound or the hydrofluorocarbon refrigerant, or metal working oils containing a component highly reactive with the polyhydric alcohol ester compound or the hydrofluorocarbon refrigerant, said method comprising the steps of: introducing the working fluid in a compressed vaporized state into a condenser to cool and liquify the working fluid therein; passing the liquified working fluid through a capillary into an evaporator at a reduced pressure; vaporizing the working fluid in the evaporator; compressing the vaporized working fluid in a compressor; and reintroducing the compressed vaporized working fluid into the condenser.

8. The method of claim 7, wherein 0.5–4% by weight of the polyoxyalkylene compound is present.

9. The method of claim 7, wherein 0.5–2% by weight of the polyoxyalkylene compound is present.

* * * * *